United States Patent [19]

Simon

[11] 4,351,413

[45] Sep. 28, 1982

[54] DECELERATION APPARATUS FOR SAFETY NETS

[76] Inventor: Wayne E. Simon, P.O. Box 125, Evergreen, Colo. 80439

[21] Appl. No.: 245,345

[22] PCT Filed: May 15, 1979

[86] PCT No.: PCT/US79/00326

§ 371 Date: Jan. 15, 1981

§ 102(e) Date: Jan. 9, 1981

[87] PCT Pub. No.: WO80/02507

PCT Pub. Date: Nov. 27, 1980

[51] Int. Cl.[3] ..... A62B 1/22

[52] U.S. Cl. ..... 182/139; 182/48; 272/65

[58] Field of Search ..... 182/137, 138, 139, 140, 182/48; 272/65; 188/266, 311, 316

[56] References Cited

U.S. PATENT DOCUMENTS

| | | | |
|---|---|---|---|
| 283,158 | 8/1883 | Smith | 182/138 |
| 300,091 | 6/1884 | Lawrence | 182/138 |
| 329,648 | 11/1885 | Huber | 182/140 |
| 448,101 | 3/1891 | Whittier | 182/138 |
| 527,594 | 10/1894 | Dromgoole | 182/139 |
| 626,812 | 6/1899 | Kirschenhofer | 182/138 |
| 2,212,460 | 8/1940 | Stephenson | 272/65 |
| 2,430,714 | 11/1947 | Geer | 182/139 |
| 3,796,281 | 3/1974 | Dowling | 182/48 |
| 3,948,351 | 4/1976 | Baumann | 182/139 |

*Primary Examiner*—Reinaldo P. Machado
*Attorney, Agent, or Firm*—John E. Reilly

[57] ABSTRACT

A landing net assembly (10) provides a controlled deceleration landing device for pole vaulters, high jumpers and the like in such a way that the impact of a free-falling body and the rate of displacement of the landing net is dampened in a controlled manner. Each of a plurality of damping devices includes a supporting post (12, 14) which contains a fluid (72) and float (76) submerged in the fluid (72), the float (76) being connected by tendons or cords (82) to the landing net (18) so that when the (18) net is displaced the float (76) is displaced within the fluid (72). In this manner, the viscous drag force of each float as it moves through the fluid and the buoyant force of the float in the fluid dissipate the initial impact of the free-falling body and damp the rate of displacement of the net.

18 Claims, 10 Drawing Figures

DECELERATION APPARATUS FOR SAFETY NETS

DESCRIPTION OF THE INVENTION

Background of the Invention

As athletic skills and abilities have improved over the years, track and field events such as high jumping and pole vaulting have been marked by dramatic increases in the height obtained by the individual performers. In particular, many pole vaulters are reaching substantial heights in their vaults so that the distance of fall is on the order of as much as 3 to 5 meters. It is necessary, of course, that the impact of this free-fall be cushioned so as to prevent injury. In the past this cushioning has been accomplished by means of large foam pads placed in an area in which the impact of the vaulter is anticipated. These foam cushions are typically one meter thick so that the vaulter is decelerated in approximately one-half of this distance which in turn results in very large deceleration forces. Even though these soft cushions alleviate many of the problems inherent in falls from these distances, a high risk of injury and death still remains due to the large deceleration forces, off-center impacts, or off-balance impacts by the vaulter.

Many of the injuries plaguing pole vaulters and high jumpers can be eliminated by intercepting the vaulter or jumper nearer to his maximum height and decelerating his fall over a substantial distance. In this process two constraints are present: First, the initial impact of the athlete must be dissipated, and second, a constant deceleration force should be provided. It is additionally helpful if the apparatus is constructed not only to cushion the impact and decelerate the fall of the athlete, but also is constructed to automatically compensate for off-center impacts which often result in wrenching of the athlete's body sufficiently to cause injury.

While others have recognized some of the problems associated with landing pads either in the field of athletic endeavors or for example, fire safety apparatus, the devices which have been developed tend to introduce substantial deceleration forces. For example, U.S. Pat. No. 626,812 issued on June 13, 1899 to Kirschenhofer discloses a dampening device which utilizes a spring with a catch to prevent rebound when an object strikes the landing net. Another patent, U.S. Pat. No. 2,430,714, issued Nov. 11, 1947 to Geer discloses a shock absorber connected to a landing net so that the net is decelerated over a very short distance, namely, the stroke of the shock absorber, by means of the viscous constraints of the fluid in the shock absorber. Also, U.S. Pat. No. 3,948,351 issued Apr. 6, 1976 to Baumann utilizes a shock absorber similar to that disclosed in the Geer patent although it is connected to the landing net in a different manner.

Although these devices afford some damping of the impact of a free falling body, especially to prevent rebound, they nonetheless are operative over only a short degree of displacement and utilize the retarding force of a viscous fluid through an orifice. This technique does not decelerate the falling body over a substantial distance but rather absorbs virtually all of the impact in a distance much shorter than that even of a foam cushion.

SUMMARY OF THE INVENTION

It is an object of the present invention to provide a novel and improved landing net assembly for absorbing the impact of a free falling body wherein the free falling body undergoes a gentle rate of deceleration.

Another object of the present invention is to overcome the initial impact of a falling body on a landing net by means of a viscous drag and buoyant forces and then counteract the weight of the body by means of these forces to decelerate the body's fall gently.

It is a further object of the present invention to connect a landing net to a plurality of dampening devices which utilize a fluid and float assembly to damp displacement of the net by counteracting forces causing the net displacement by transferring these forces to one or more floats so that the viscous drag and buoyant force of the float damps the rate of displacement of the net.

It is yet another object of the present invention to provide a plurality of dampening devices associated with a landing net which are cross connected so as to distribute the gravitational force of a free falling body to an intermediate portion of the landing net for both central and off central points of impact.

It is yet another object of the present invention to provide a landing net assembly which is rigidly supporting and which is able constantly to decelerate the rate of descent of a free falling body impacting thereon and which also provides a supplementary catching net and cushion for bodies approaching the assembly from a lateral direction beneath the primary landing net.

In order to accomplish the foregoing objects, the preferred embodiment of the present invention utilizes a generally rectangular landing net suspended from four upright support posts by connecting means in the form of a plurality of tendons or cords. Each cord is secured to a dampening device associated with a support post according to the preferred embodiment of the present invention, and each dampening device operates to dissipate the impact of the free falling body on the net and to decelerate at a constant rate the fall of that body.

One such dampening device is contained within each upright support post and each utilizes a two-fold approach in cushioning the landing of the free falling body. Initially, the impact of the free falling body on the landing net is dissipated by means of a viscous drag force and by a buoyant force supplied by the dampening device. Next, the viscous drag and buoyant forces cooperate to decelerate the body at a constant rate so as to counteract with the weight of the body.

Specifically, each dampening device includes a fluid, preferably water, contained in the hollow support posts and a float is suspended in this fluid by means of a cord which extends downwardly to a pulley member at the bottom of the post and then upward along the interior sidewall of the post so that it will extend over a second pulley located on top of the hollow post. The cord may then be attached to the net at a convenient location such as at one corner of the net. Each float is operative to position a corner of the net by means of the buoyant force and imparts counteracting forces to the fall and weight of the body upon the landing net.

The float, as noted, is operative to impart both a drag force and a buoyant force. The viscous drag of the float through the water is, of course, dependent upon the ratio between the cross-sectional diameter of the float as compared to the cross-section of the hollow post. The buoyant force on the other hand is a function of the volume of the float and the specific gravities of the float and the fluid. Specifically, the weight of the falling object is under a constant deceleration force caused by the constant buoyant force of the float in the fluid so that the dissipation of the vaulter's body after initial contact with the net occurs over a substantial distance. In other words, the force of gravity is counteracted by the oppositely directed viscous and buoyant forces.

The apparatus, in the preferred embodiment, also includes a cross-rigging system of cords and pulleys interconnecting the floats on opposite diagonal posts so that displacement of a float in one post causes a corresponding displacement of the float in the opposite diagonal post. Since each of these floats is connected to a corner of the rectangular landing net, movement of each causes a displacement of the landing net with opposite corners of the landing net undergoing a corresponding displacement. In this manner, when a falling body impacts the landing net off-center, a displacement of the net portion at the point of impact will cause a corresponding displacement of an asymmetric portion of the net thereby tending to direct the falling body toward the central point on the landing net. Hence, there is an automatic centering of the falling body to counteract any tendency of the body to fall off of the net.

Additional features of the preferred embodiment include the positioning of a foam cushion along a forward portion of the assembly and adjacent a pair of the support posts. A skirt is then connected along one edge to an edge of the landing net and along the other edge to these cushions so as to provide a safety or auxiliary landing net should a pole vaulter fail to reach the primary landing net which is connected to the dampening devices. Of course, the landing net of the present invention may be modified in height for various uses, such as for high jumping of pole vaulting, and the dampening device may readily be adapted to uses other than for athletic events, such as, for fire protection equipment, acrobatic activities and the like.

The above and other objects, advantages and features of the present invention will become more readily appreciated and understood from a consideration of the following description of the preferred embodiment when taken together with the accompanying drawings thereof, in which:

DETAILED DESCRIPTION OF THE PREFERRED EMBODIMENT

The present invention may be best exemplified by describing its use as a landing net assembly for pole vaulters, high jumpers and the like which is constructed to be a safe dependable system for dissipating and cushioning the impact of a free falling body landing on the net. The preferred embodiment of the present invention utilizes a support framework and a set of upright posts to which a landing net is attached by a plurality of dampening devices which dissipate the energy of the impact and damp the displacement of the landing net.

Figure 1:
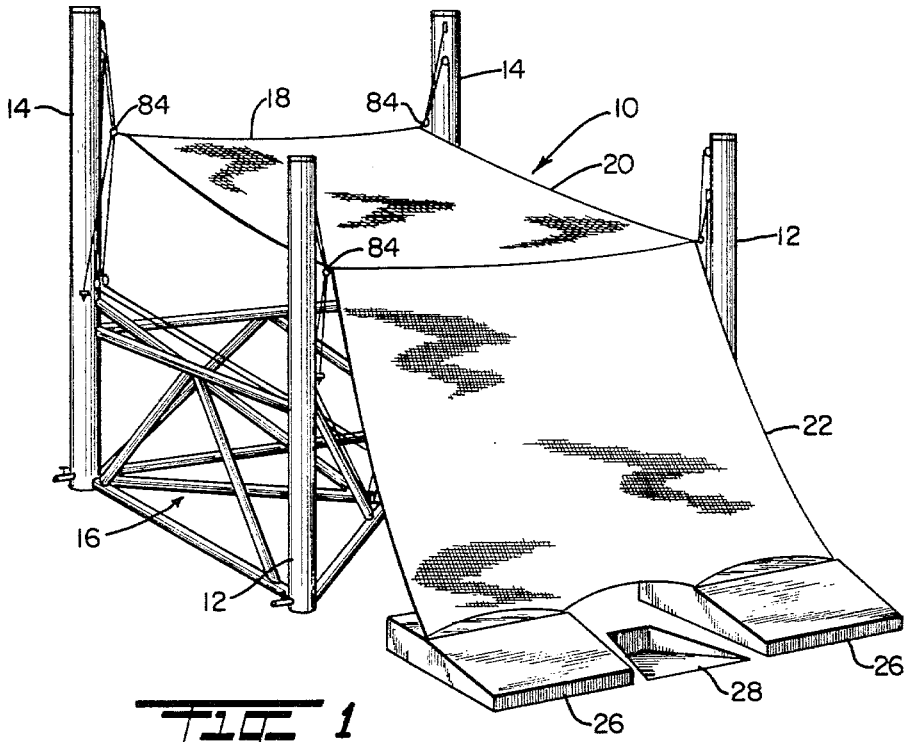
FIG. 1 is a perspective view of a landing net assembly according to the preferred embodiment of the present invention.

The preferred embodiment of the present invention is shown in FIG. 1 wherein landing net assembly 10 is shown including a pair of forward support posts 12 and a pair of rear support posts 14 which are rigidly interconnected by framework 16 to provide an upright rigid support system for a landing net 18 attached thereto. Posts 12 and 14 may be arranged in a square, rectangular or trapezoidal configuration, with the forward posts 12 being spaced further apart from one another when a trapezoidal configuration is selected. Landing net 18 is formed of two sections, an upper main panel 20 which comprises the landing surface for a pole vaulter or high jumper, and an inclined panel 22 which is attached to main panel 20 along one edge or seam 24, but it should be appreciated that main panel 20 and inclined panel 22 could be formed as a unitary sheet. Main panel 20 is shown as being of generally trapezoidal or rectangular configuration although it will be apparent that it may be rounded or of a circular configuration. To complete the structure, inclined panel 22 is attached along an edge opposite seam 24 to a pair of pod cushions 26 which are adjacent a vaulting pod 28 on opposite lateral sides thereto. Pod cushions 26 are typically staked or otherwise secured to their support surfaces. The attachment between panel 22 and pod cushions 26 may be by means of snaps or hooks or any other convenient fastening means. Further, it should be understood that pod cushions 26 and inclined panel 22 are included in the preferred embodiment but are not essential within the scope of this invention as hereinafter described.

Figure 2:
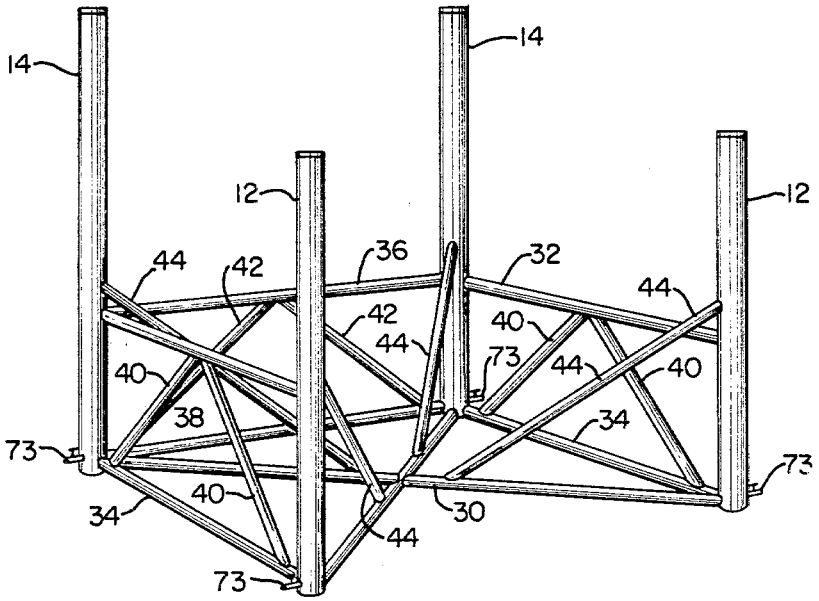
FIG. 2 is a perspective view of the support structure for the landing net according to the preferred embodiment of the present invention.

The support structure or truss work for landing net 18 is more fully shown in FIG. 2. Forward support posts 12 and rearward support posts 16 form the four corners of a framework so that they extend upwardly from the surface upon which the framework is placed. Posts 12 and 14 are interconnected at their bases by means of a cross member 30 and each of posts 12 is connected to an adjacent post 14 by parallel beams 32 and 34 which are oriented to be normal to the vertical posts. Similarly, rearward support posts 14 are connected to each other by means of beams 36 and 38 which form a horizontal pair of upper and lower support members. Each pair of beams 32 and 34 are interconnected and supported by a pair of diagonal support members 40 which form an inverted V-shaped support wherein one end of each of diagonal support members 40 is connected to an opposite end of truss 34 with diagonal support members 40 converging at opposite ends to a point of attachment on the center portion of a respective beam 32. Each pair of beams 36 and 38 are connected in a similar manner by diagonal support members 42 with one end of each diagonal support members 42 being attached at opposite ends of beam 38 so that they converge to the central portion of beam 36 again in the form of an inverted V-shaped support. To complete the support structure, four diagonal beams 44 interconnect a medial portion of the respective posts 12 or 14 with the center of cross member 30. Cross member 30, beams 32, 34, 36 and 38 as well as diagonal support members 40, 42 and diagonal beams 44 are preferably formed of tubular rigid plastic and are attached to posts 12 and 14 and to each other by means of gluing or other structurally acceptable means as known in the art. However, it is also possible to construct this structure out of tubular steel, aluminum, or any other structural material. The dimensions of the main support structure should be selected such that the completed structure will be rigid and of sufficient strength to support the impact of a free falling body on the landing net supported thereby. While the described trusswork is preferred, it is possible to eliminate it entirely if the upright posts 12 and 14 are rigidly attached to caissons permanently affixed in the ground.

Figure 3:
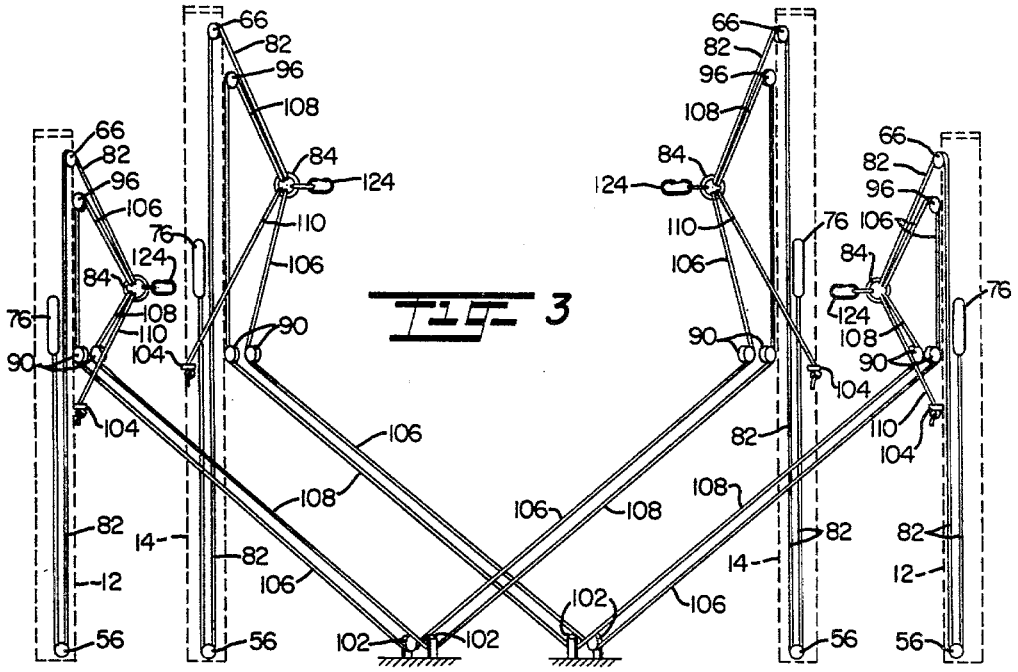
FIG. 3 is a front view in elevation of the rigging for the landing net according to the preferred embodiment of the present invention.
Figure 8:
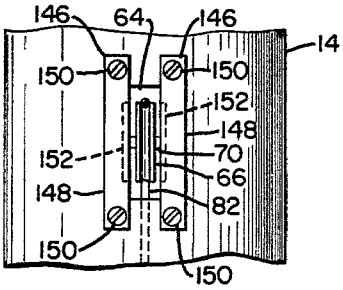
FIG. 8 is a front enlarged plan view of yet another pulley supporting the rigging shown in FIG. 3.
Figure 9:
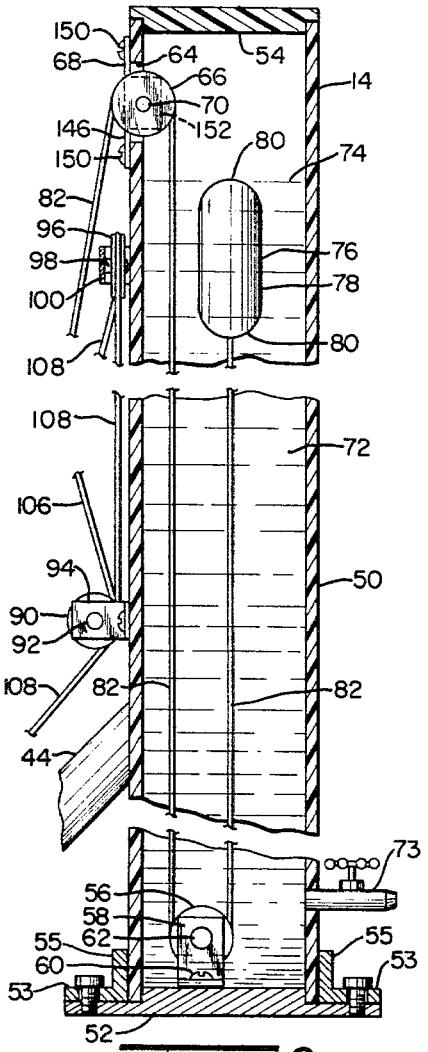
FIG. 9 is a cross-sectional view in vertical section of one of the support posts according to the preferred embodiment of the present invention.
Figure 10:
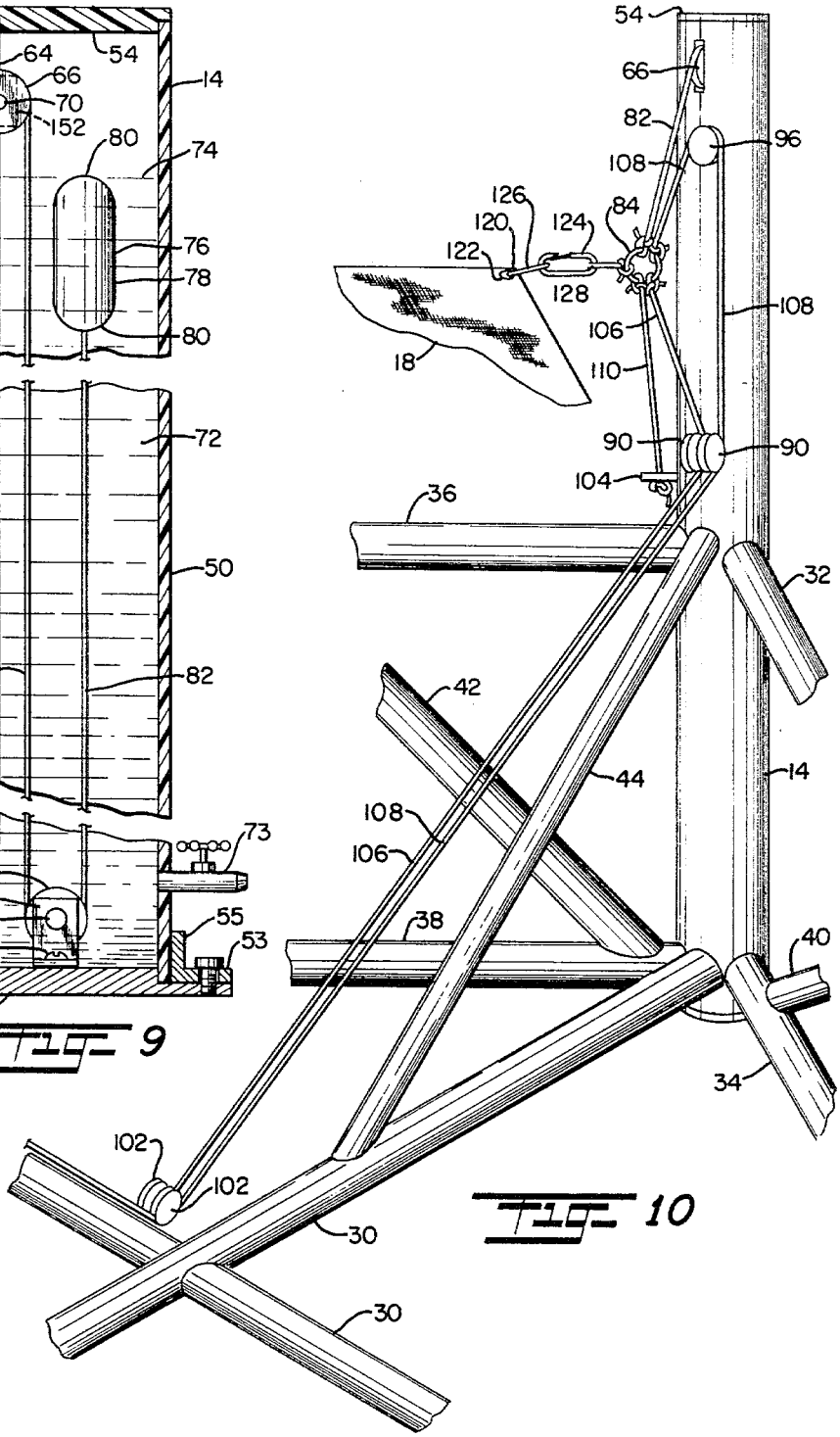
FIG. 10 is an enlarged fragmentary view in perspective of one of the support posts with its associated landing net attachment means and net rigging according to the preferred embodiment of the present invention.

An important feature of the present invention resides in the damping system which is connected to landing net 18 so that an object which impacts landing net 18 is decelerated at a controlled rate. The main features of this damping system are shown in FIGS. 3 and 8 which show the rigging system for landing net 18 and in FIG. 9 which shows the actual dampening device. With respect to FIG. 9, there is shown a rearward support post 14 in vertical section. It should be understood, however, that a similar dampening system is contained within each of forward support posts 12 as well as both rearward support posts 14 in the preferred embodiment of the present invention. Support posts 12 and 14 may be constructed identically and, as represented by support post 14 in FIG. 9, each is an elongated hollow plastic cylinder 50 which is closed at a lower end by a plastic endplug 52 and at an upper end by endplug 54. Endplug 52 is preferably bolted to a flange 53 on jacket 55 which is attached to the lower end of cylinder 50. Endplug 52 seals off the lower end of cylinder 50 while endplug 54 may optionally be secured to the upper end of cylinder 50 in any convenient manner. Endplug 52 has a guide pulley 56 mounted thereon by means of a pair of brackets 58, one of which is shown in FIG. 9. Bracket 58 is secured to endplug 52 by means of screws 60 and pulley 56 is rotatably supported between the pair of brackets 58 by means of a shaft 62 journaled therein. At the upper end of hollow cylinder 50, adjacent endplug 54, is cut a slot 64 wherein a guide pulley 66 is mounted by means of a pair of brackets 68 which will be described more fully with reference to FIG. 8. Guide pulley 66 is rotatably mounted on shaft 70 which is journaled in brackets 68. In the above-described manner, it may be appreciated that hollow cylinder 50, along with endplugs 52 and 54 make a substantially closed container, and this container is then substantially filled with a fluid 72 by means of a conventional faucet 73 mounted in the sidewall of cylinder 50 at a lower end thereof. Faucet 73 permits filling and draining of posts 12 and 14 and acts as a valve for this process. Preferably fluid 72 is water and hollow cylinder 50 is filled approximately 90° full so that, when each hollow post 12 or 14 is supported in a vertical orientation, the fluid level 74 is just below slot 64. A float 76 is positioned in fluid 72, and float 76 is constructed with a cylindrical main body portion having hemispherical ends 80. The position of float 76 in fluid 72 is such that it rests with the upper hemispherical end 80 at the fluid level 74. However, float 76 may be submerged at any point within fluid 72, and the operation and function of float 76 will be described in greater detail hereinafter. Further, float 76 is maintained in position by means of a cord 82 which is secured in any convenient manner at lower hemispherical end 80 such that it passes downwardly through hollow cylinder 50, underneath pulley 56 and then back through hollow cylinder 50 so that it extends through slot 64 and over pulley 66 where it is attached to landing net 18. Preferably, cord 82 is formed of a water resistant material, such as Nylon, so that it will not be affected or deteriorated by fluid 72. As shown in FIGS. 3 and 10, cord 82 is attached at an end opposite float 76 to a rigid ring 84 located externally of an associated hollow post 12 or 14.

In operation, whenever a sudden force is applied in a downward direction on ring 84, cord 82 is drawn downward so that float 76 is forced to undergo movement in a downward direction through fluid 72. It should be appreciated that float 76 is buoyant in fluid 72 so that, for a force application in a downward direction on ring 84, two physical events take place. First, the sudden shock of the application of the kinetic force of the moving body on the landing net is transferred to ring 84 and is then dissipated as a result of the viscous drag of float 76 in fluid 72 and the buoyant force acting on float 76. This viscous drag is inversely proportional to the difference between the cross-sectional area of hollow cylinder 54 and the cross-sectional area of float 76 and directly proportional to float velocity. However, once this initial impact is dissipated and the constant force of gravity, that is, the body's weight, the viscous drag force of float 76 in fluid 72 and the buoyant force acting on float 76 as a result of its submersion in fluid 72 cooperate to counteract the force of gravity. Since the ratio of the cross-sectional area of difference between cylinder 50 and float 76 is rather small, the force of gravity is balanced at a fairly low velocity and therefore tends to uniformly damp the force being applied in a downward direction on ring 84. This process will be described in greater detail hereinafter with reference to landing net 18.

A second important feature of the present invention is the utilization of a cross-rigging system whereby opposite diagonal pairs of posts 12 and 14 are interconnected to one another. As may be seen in FIGS. 3, 9 and 10, each one of posts 12 and 14 have mounted a plurality of guides or pulleys thereon, and cross member 30 also supports a plurality of guides or pulleys. Specifically, each one of posts 12 and 14 have a pair of medial pulleys 90 which are independently rotatable on shaft 92 which is mounted to cylinder 50 by means of a pair of L-shaped brackets 94. Each of posts 12 and 14 has an upper pulley 96 which is rotatable about a fixed shaft 98 which is mounted by support bracket 100. The mounting of these pulleys will be described in greater detail with respect to FIGS. 4–8. Additionally, cross member 30 supports two pair of pulleys 102 in any suitable manner with pulleys 102 having representative support structure shown in FIG. 3. Finally, each of posts 12 and 14 includes a rigid post 104 mounted at a medial portion thereon.

The manner in which the cross-rigging is arranged may be best seen in FIGS. 3 and 10. With respect to FIG. 3, it may be seen that opposite diagonal posts 12 and 14 are cross-rigged by means of a pair of cords, 106 and 108, attached to respective rigid rings 84. As may be seen in FIG. 3, cord 106 is attached to ring 84 adjacent a forward post 12 and extends in an upward direction over pulley 96 and then downward along the outer surface of post 12 and then around one of the pair of pulleys 90. Cord 106 then extends diagonally to the center of cross member 30 where it passes underneath one of pulleys 102. Cord 106 then extends diagonally upward to one of pulleys 90 mounted on diagonal rearward support post 14 and directly upward to be attached to the support ring 84 associated with the diagonal rearward post 14. Cord 108 is attached to ring 84 associated with post 14 and extends upwardly over pulley 96, downwardly along the surface of post 14 to the other pulley 90 located at a medial portion thereof after which it extends diagonally to a pulley 102, cord 108 extends diagonally upward to pass around the other of the pair of pulleys 90 associated with an opposite diagonal forward post 12 and, after extending around pulley 90, cord 108 extends upwardly to be attached with the ring 84 associated with that opposite diagonal post 12. It should be appreciated that both pairs of opposite diagonal posts 12 and 14 are interconnected in this manner.

As shown in FIG. 3, it may be seen that whenever any one of rigid rings 84 undergoes a downward motion, the associated cords 106 and 108 cause the rigid ring 84 associated with the opposite diagonal post to undergo a corresponding downward motion. Further, since float 76 in each of the opposite diagonal posts is connected to its associated ring 84, floats 76 in opposite diagonal posts undergo corresponding motion as well.

The rigging system is completed by means of a plurality of cords 110 each of which are connected at one end to an associated rigid ring 84 and at the opposite end to mounting post 104. Cords 110 operate to limit the upper position of associated rings 84 so that there is a maximum upward position of ring 84 with respect to the top of an associated post 12 or 14.

Referring to FIGS. 1 and 10, it may be seen that landing net 18 is secured at each corner to a rigid support ring 84. With particular reference to FIG. 10, it is seen that corner 120 of landing net 18 has an opening 122 formed therein and it is preferable that opening 122 comprises a rigid steel, brass grommet or open rivet. Corner 120 is secured to an elongated releasable link 124 by means of a cord 126 which passes through grommeted opening 122. The use of an open rivet or grommet in opening 122 is therefore understandable since structure aids in preventing the tearing of the fabric forming landing net 18. Releasable link 124 is then secured to ring 84 by means of a tie-off cord 128 so that the corner 120 of landing net 18 is secured to ring 84 and the associated cross-rigging system of landing net assembly 10. It should be understood that other attachment means for landing net 18 are contemplated and are within the scope of this invention, but the one described above has been utilized with success in the preferred embodiment.

Figure 4:
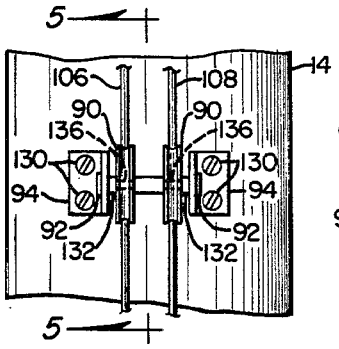
FIG. 4 is a fragmentary view enlarged in elevation of one set of pulleys supporting the rigging shown in FIG. 3.
Figure 5:
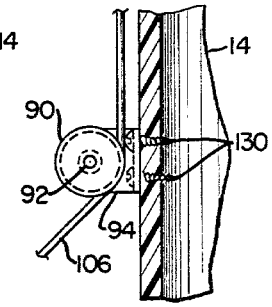
FIG. 5 is a cross-sectional view of the set of pulleys taken about line 5—5 of FIG. 4.

FIGS. 4–8 illustrate the support structure for various ones of the pulleys utilized in the cross-rigging network. FIGS. 4 and 5 show the support structure for pulleys 90 with the support structure being defined by a pair of L-shaped support brackets 94 which support a shaft 92. Brackets 94 are secured to an associated support post 12 or 14 by means of a plurality of screws 130 which are threaded into the support posts. In FIG. 4, pulleys 90 are fragmented to show shaft 92 which includes a pair of end caps 132 which support an elongated rod having enlarged center section 134 and smaller diameter end sections 136. As may be appreciated, center section 134 operates as a spacer for pulleys 90 which are rotatably journaled on end sections 136. End caps 132 then mount the pulleys to L-shaped brackets 94 and provide a spacing to maintain pulleys 90 in spaced-apart relation from L-shaped brackets 94. Of course, any other suitable pulley support could be utilized as known in the art.

Figure 6:
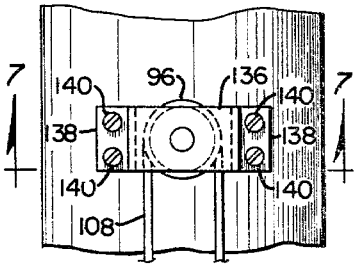
FIG. 6 is a fragmentary enlarged view in elevation of another support pulley for the rigging shown in FIG. 3.
Figure 7:
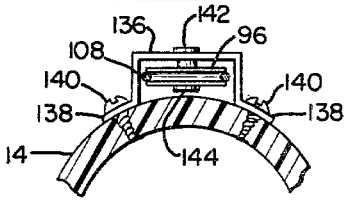
FIG. 7 is a sectional view taken about line 7—7 of FIG. 6.

FIGS. 6 and 7 disclose a pulley mount structure for pulley 96 which is a generally U-shaped bracket 136 having angled feet 138, with angled feet 138 being secured to a respective support post 12 or 14 by means of screws 140 threaded therein. U-bracket 136 supports a rigid shaft 142 in perpendicular relation thereto with pulley 96 being rotatably mounted on shaft 142 by means of end cap 144. Again, other attachment and support structures are possible for each of pulleys 96.

Finally, FIG. 8 illustrates the support structure for pulley 66, and reference is made also to FIG. 9 showing further detail of this support structure. As may be seen in FIGS. 8 and 9, pulley 66 is adapted to be mounted in slot 64 so that a portion of pulley 66 protrudes externally of one of posts 12 or 14 while the remaining portion of pulley 66 projects internally of post 12 or 14. This attachment is accomplished by means of a pair of L-shaped brackets 146 which have one leg 148 secured to the external surface of an associated post 12 or 14 by means of screws 10 threaded therein. The other or perpendicular leg 152 of each L-shaped bracket 146 projects internally into posts 12 or 14 through slot 64. Legs 152 then support shaft 70 which rotatably mounts pulley 66 in any convenient manner. It is noted that no specific support brackets are illustrated for pulleys 102, however, any bracket structure that rotatably mounts pulleys 102 to cross member 30 as known in the art is acceptable and is contemplated by this invention. Indeed, a bracket structure such as shown in FIGS. 4 and 5 is suitable with only slight modification to allow attachment to cross member 30.

Returning once again to FIG. 1, it may be seen then that the landing assembly net according to the present invention increases the cushioning of the landing of a vaulter or high jumper thereby enhancing safety. Typically, posts 12 and 14 are between 4 and 5 meters high, and are spaced apart from one another approximately 5 meters. Posts 12 are, in the preferred embodiment, slightly shorter than posts 14, and, when a trapezoidal support structure is selected, posts 12 are spaced further apart than posts 14. Landing net 18 and in particular main panel 20 is then positioned approximately 3 to 4½ meters above the ground so as to intercept a vaulter at an elevated point. Of course, when the device is used for high jumping, the posts could be significantly shorter and main panel 20 should be positioned at a lower distance. Further, inclined panel 22 extends from main panel 20 downwardly to a pair of cushions made out of foam rubber or the like which flank pod 28 so that, if a vaulter or jumper does not achieve sufficient elevation to land on main panel 20, the athlete will nevertheless receive a cushioning effect on panel 22 from forward posts 12.

While each post could be rigged independently for cushioning its respective corner, the cross-rigging described above provides a further advantage over prior art devices. Specifically, whenever the athlete impacts main panel 20 at an off-center location, the cross-rigging causes a cooperation between diagonal corners so that the athlete is directed more to the center of the net rather than being thrown off the edge since diagonal corners undergo corresponding movement.

It is preferable to decelerate the body of the athlete as gently as possible, and, to this end, the present invention provides for a loading factor of approximately 1.5 gravities so that a vaulter attaining a height of 5½ to 6½ meters impacting main panel 20 located at a height of approximately 4 meters would have that impact dissipated over approximately 3 meters of traveling distance. To accomplish such a loading, posts 12 and 14 are typically approximately 20 centimeters in internal diameter while float 76 is typically on the order of an outside diameter of approximately 15 centimeters so that it preferably has a total volume of approximately 12–13 liters, but this may be varied successfully between 10 and 20 liters. At any rate, it is desired that the buoyant force be selected within the range of approximately 9–18 Kg or 80–180 newtons.

The present invention has been utilized for practice falls as a method of analysis. The results, where the net is positioned as described above, indicated that the total deceleration process occurred over an interval of about one second, followed by a constant velocity traverse to the bottom of the assembly at an average velocity of 0.27 m/sec. The average peak velocity of the body for three jumps was 3.35 m/sec. ranging from 2.8 to 3.8 m/sec. The average peak deceleration for three jumps was 2.1 g., ranging from 1.4 to 2.7 g.

Although the present invention has been described with particularity relative to the foregoing detailed description of an exemplary preferred embodiment, various modifications, additions, changes and applications other than those specifically mentioned herein will be readily apparent to those having normal skill in the art without departing from the spirit of this invention.

I claim:

1. A landing net assembly adapted for cushioning the impact of a free falling body comprising a landing net and a plurality of support members in outer surrounding relation to said landing net, a dampening device associated with at least one of said support members, said dampening device including a chamber filled with a fluid, a float suspended in said fluid, and connecting means interconnecting each said float and an outer peripheral edge portion of said net so that the displacement of said landing net imparted to the outer peripheral edge portion adjacent said dampening device will cause a displacement of its respective float in said chamber.

2. A landing net assembly according to claim 1 including a pair of dampening devices associated with a pair of support members in diametrically opposed relation to one another, said connecting means including cross-rigging interconnecting said pair of dampening devices whereby displacement of the float of one of said pair of dampening devices and the associated outer peripheral edge portion of said landing net is imparted to the float of the other of said pair of dampening devices and its associated outer peripheral edge portion of said landing net.

3. A landing net assembly according to claim 2 wherein said landing net is generally rectangular and is supported at each corner by one of said support members, each supprt member having a dampening device defined by an upright hollow post defining each said chamber and containing said fluid and said float.

4. A landing net assembly according to claim 3, said connecting means including cross-rigging interconnecting said floats in diagonally opposite ones of said hollow posts whereby displacement of a corner of said landing net and its respective said float causes displacement of the diagonally opposite corner of said landing net and its respective said float.

5. A landing net assembly according to claims 3 or 4 wherein a first pair of said posts adjacent to one another are of substantially the same length and a second pair of said posts adjacent to one another are of a common length with said first pair of posts being shorter than said second pair of posts.

6. A landing net assembly according to claim 5 wherein the spacing between said first pair of posts is greater than the spacing between said second pair of posts.

7. A landing net assembly according to claims 3 or 4 including a cushion member positioned outwardly of but adjacent to the bases of two of said posts, said landing net is elevated above the bases of said posts, and a skirt secured for extension downwardly from an edge of said landing net to said cushion member.

8. A landing net assembly according to claim 1 wherein the cross-sectional area of said chamber is approximately twice the cross-sectional area of said float.

9. A landing net assembly according to claim 1 wherein said float has a volume between 10 and 20 liters and said fluid is water.

10. In an apparatus including a landing net for cushioning the impact of a free falling body, a dampening device comprising:

an upright, elongated, hollow cylindrical tube enclosed on the bottom end;

a fluid contained in said tube;

a first guide member attached to the interior of said tube at a lower end portion thereof;

a second guide member attached to said tube at an end portion opposite said first guide member;

a first cord adapted to be secured to said landing net, said first cord passing over said second guide member, through the interior of said tube, under said first guide member and upward to an upper portion of said tube; and a float secured to said first cord at the upper portion of said tube, said float being suspended in said fluid.

11. A dampening device according to claim 10 wherein said tube has a slot through its sidewall adjacent said second guide member, said slot receiving and guiding said first cord at a portion thereof between said landing net and said second guide member.

12. A dampening device according to claims 10 or 11 including a third guide member mounted on the exterior sidewall of said post at a midportion thereof and a second cord adapted to be secured to said landing net, said second cord being supported by said third guide member.

13. A dampening device according to claim 10 wherein the buoyant force of the float in the water is between 80 newtons and 180 newtons and wherein the ratio of the cross-sectional area of said tube taken about a plane perpendicular to the longitudinal axis and the cross-sectional area of the float taken about said plane is on the order of 2:1.

14. A dampening device according to claim 13 wherein said tube is at least 4 meters in length, said float being positioned for travel through said tube for a distance of at least three meters.

15. A dampening device according to claim 10 including a post attached to the exterior of said tube at a midportion thereof and a second cord secured at one end to said landing net and at the other end to said post, said second cord constraining the movement of said landing net in a direction toward the upper portion of said tube.

16. A landing net assembly adapted for cushioning the impact of a free falling body comprising:

a landing net;

a plurality of support members in outer surrounding relation to said landing net;

a dampening device associated with each said support member, each said dampening device including a chamber filled with a fluid, a float suspended in said fluid, and connecting means interconnecting each said float and an outer peripheral edge portion of said net so that the displacement of said landing net imparted to the outer peripheral edge portion adjacent each said dampening device wil cause displacement of its respective float along the longitudinal axis of said chamber;

second connecting means interconnecting selected pairs of said floats so that displacement of one of said selected pair of floats will cause a corresponding displacement of the other of said selected pair of floats; and limit stop means secured to the outer peripheral edge portion of said net so that movement of said net in a direction toward one end of said support members is limited by said limit means.

17. A landing net assembly according to claim 16 adapted to be placed on a support surface, said landing net assembly including rigid interconnecting members rigidly interconnecting said support members in upright relation to said support surface, said float and said limit means positioning said landing net at a position at least 3 meters above said support surface.

18. A landing net assembly according to claim 16 wherein each said dampening device is contained within a support member, each said support member being at least 4 meters long.

* * * * *